US005186704A

United States Patent [19]

Cunningham, Jr.

[11] Patent Number: 5,186,704

[45] Date of Patent: Feb. 16, 1993

[54] DUCT FORMING MACHINE

[75] Inventor: Robert A. Cunningham, Jr., Argyle, Tex.

[73] Assignee: Glass Master Corporation, San Antonio, Tex.

[21] Appl. No.: 869,321

[22] Filed: Apr. 15, 1992

[51] Int. Cl.[5] ..... B31B 3/72; B31B 3/60; B31F 1/00; B65H 45/22

[52] U.S. Cl. ..... 493/18; 493/19; 493/117; 493/295; 493/302; 493/382

[58] Field of Search ..... 493/18, 19, 29, 117, 493/287, 295, 302, 382

[56] References Cited

U.S. PATENT DOCUMENTS 4,070,954 1/1978 Cailey ..... 493/19
4,227,955 10/1980 Woods et al. ..... 493/117
4,528,053 7/1985 Auer ..... 493/52
4,633,642 1/1987 Lissoni ..... 53/137
4,658,563 4/1987 Lissoni ..... 53/137
4,875,895 10/1989 Donnay et al. ..... 493/117
5,025,608 6/1991 Marchetti ..... 53/135.1

*Primary Examiner*—William E. Terrell
*Attorney, Agent, or Firm*—M. H. Gay

[57] ABSTRACT

A duct closure machine for closing duct board into duct with tape which can close duct having four or more sides. Duct board is moved through the machine by a single source of power driving upper and lower rollers with the lower set of rollers movable to accomodate duct of different size. The tape applicator is shiftable laterally to apply tape to duct of different number of sides such as ten sides. The tape applicator is controlled with a simple power circuit in which power to cut off the tape is only applied for a brief time as the completed duct passes through the machine.

5 Claims, 5 Drawing Sheets

DUCT FORMING MACHINE

This invention relates to machines for forming duct board into a finished duct.

Duct forming machines are known for forming four sided duct from duct board. See U.S. Pat. No. 4,070,954. This machine is not capable of forming duct of more than four sides, such as a ten sided duct. Further the machine is not capable of forming duct of both four sides and more than four sides.

An object of this invention is to provide a duct forming machine for forming duct of five or more sides.

Another object of this invention is to provide a duct forming machine for forming both four sided duct and duct of five or more sides.

Another object is to provide a machine as in the above objects in which different size duct may be formed using a single drive source for moving the duct board through the machine and in which duct tape is applied to a board and cut free with a simple automatic control system.

Another object is to provide a machine as in the preceding object in which the control system requires two or less switches to control the system.

Other objects, features and advantages of the invention will be apparent from the drawings, the specification and the claims.

In the drawings wherein like reference numerals indicate like parts:

Figure 1:
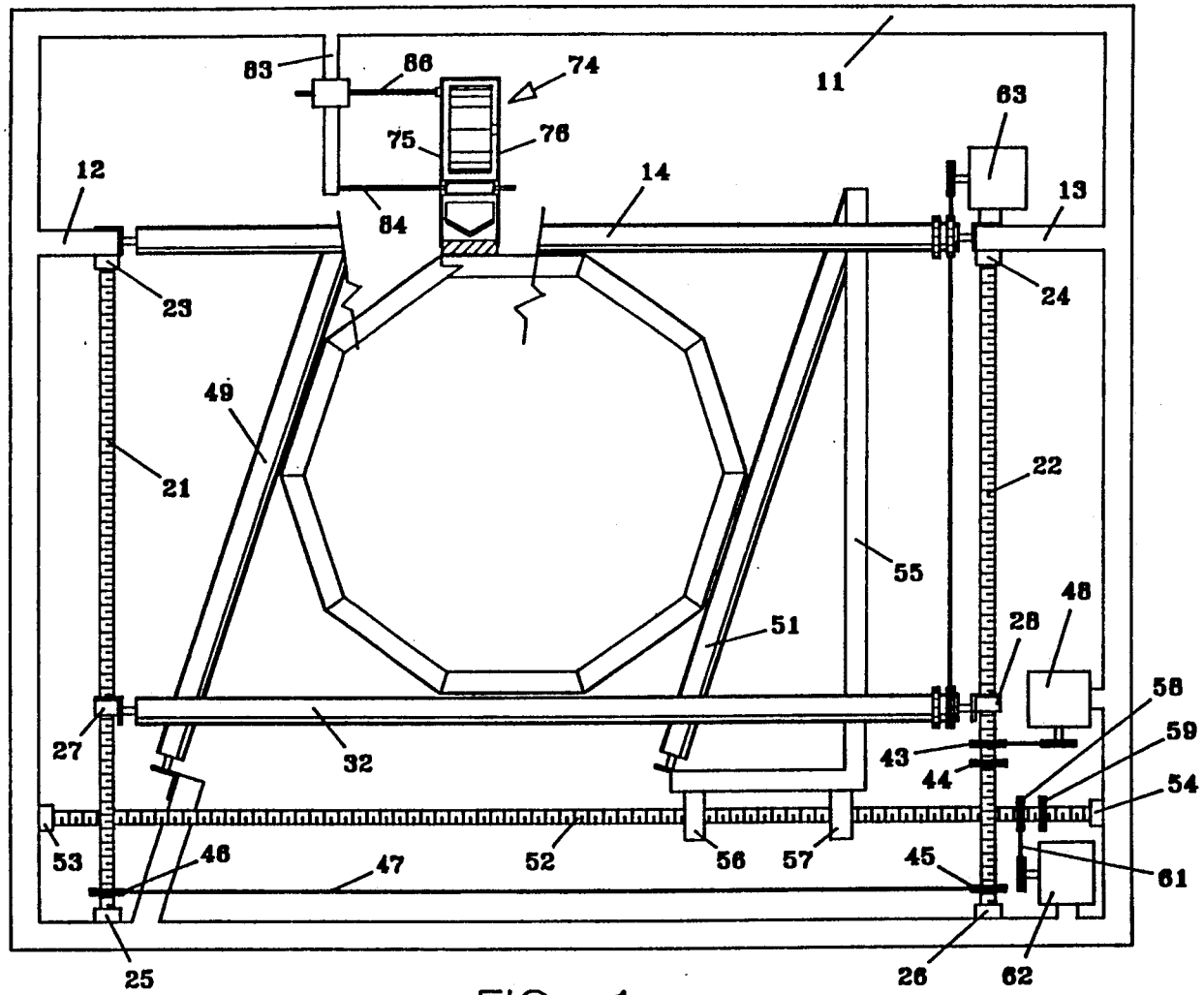
FIG. 1 is a schematic end view of a machine for practicing this invention showing decaduct being formed from duct board.
Figure 2:
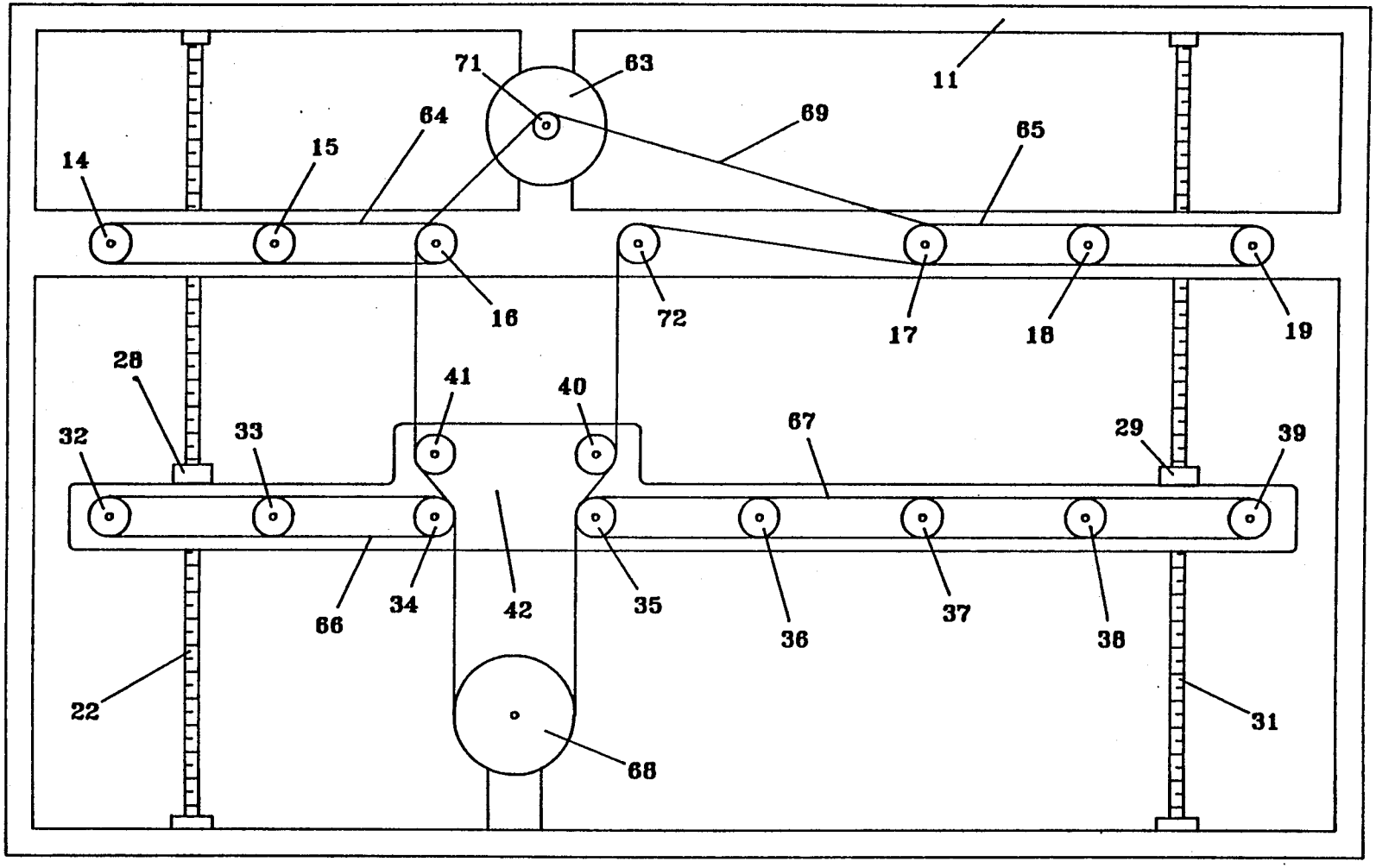
FIG. 2 is a schematic view of the system for driving a duct through the machine.
Figure 3:
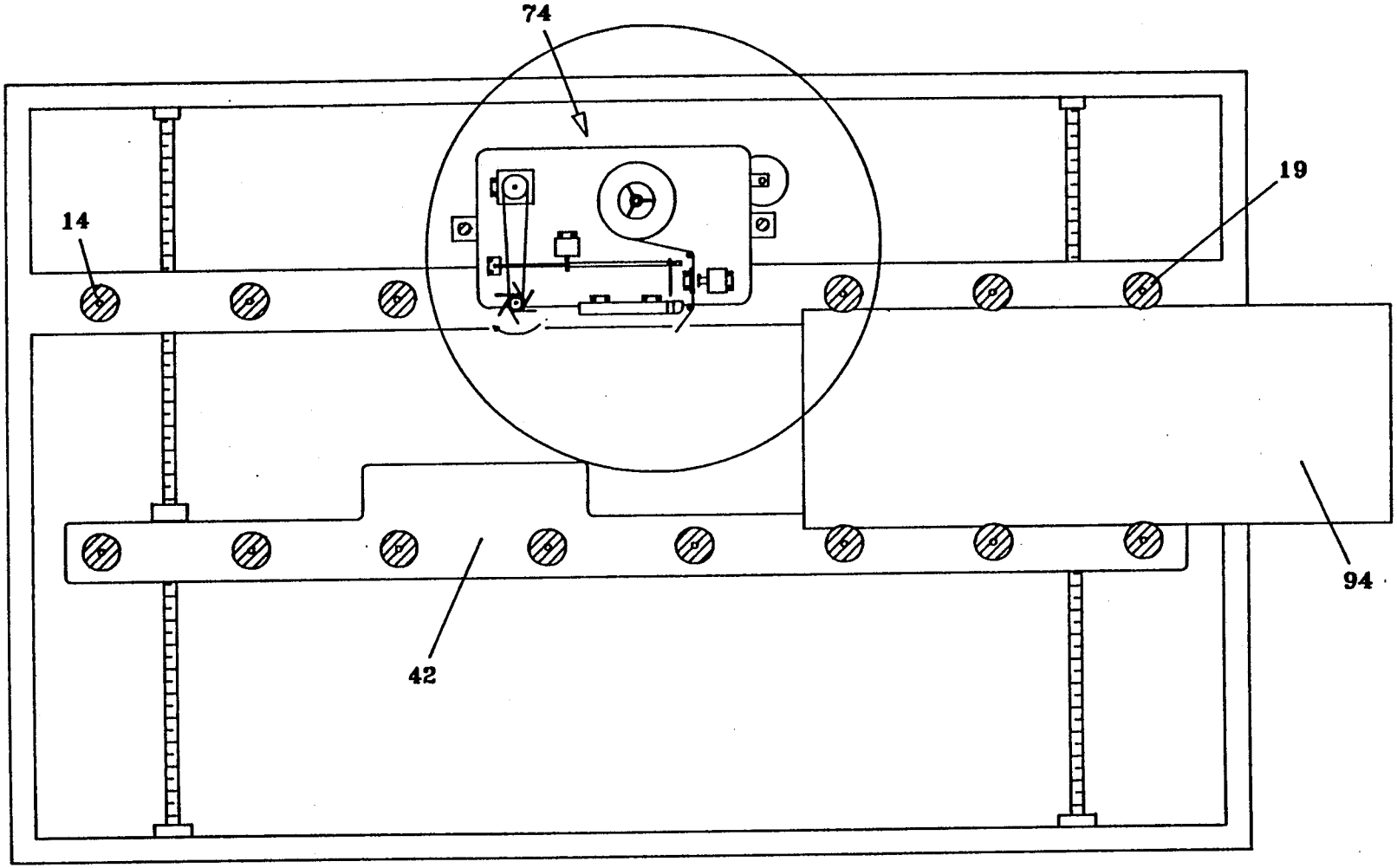
FIG. 3 is a side schematic view of a duct board moving through the machine and the tape applying system of the machine.
Figure 4:
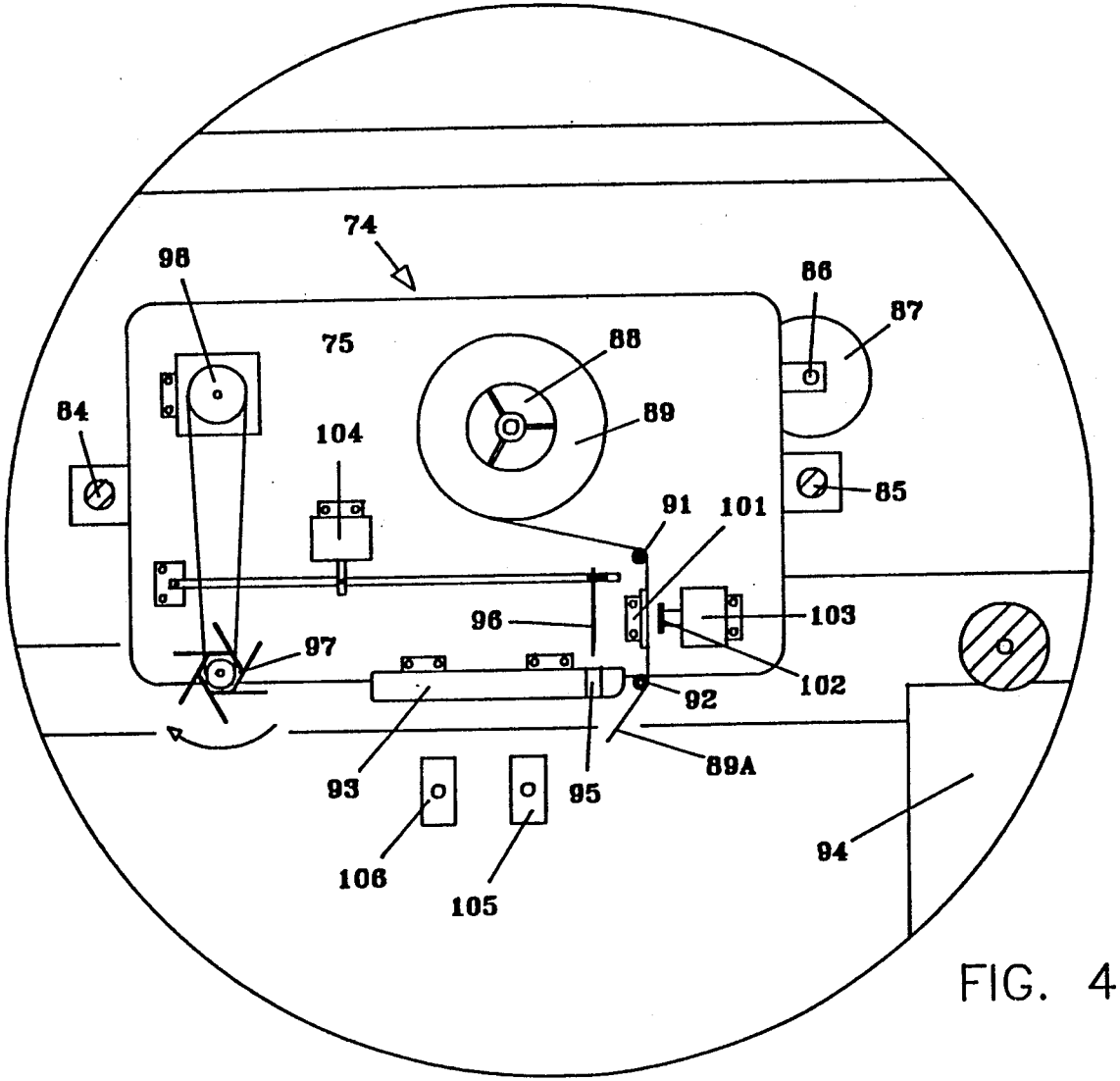
FIG. 4 is an enlarged schematic view of the tape applying system within the circle in FIG. 3.

FIGS. 1 and 2 illustrate the adjustable system for forming duct of different size. A frame 11 supports the various components of the system. Supports 12 and 13 support the upper roller set including rollers 14 through 19 which are fixed to the frame 11. Screws 21 and 22 are journalled to supports 12 and 13 respectively at their upper ends by bearings 23 and 24 and to the frame 11 by journals 25 and 26 at their lower ends. A like screw 31 and a fourth screw not shown provide a rectangular set of four screws for supporting the movable set of rollers including rollers 32 through 41 mounted on the movable frame 42. These screws are ganged together by sprockets as shown at 43 through 46 and chains such as shown at 47; all driven by motor 48 to raise and lower the lower set of rollers for different size duct.

The duct being formed is supported on one side by a set of fixed rollers including roller 49 extending along one side of the duct in the conventional manner. A like set of movable side rollers including roller 51 supports the other side of the duct. The set of side movable rollers is supported on two spaced screws, one of which is shown at 52 journaled to the frame at 53 and 54. A movable frame 55 carried on nuts on the spaced screws such as nuts 56 and 57 provide for adjustment of the side roller frame to accommodate different size duct. The screws supporting the movable side roller frame are ganged together by sprockets and chains such as shown at 58, 59, and 61, and rotated by motor 62 to move the side roller frame and set of side movable rollers.

To move a duct through the machine opposed sets of rollers such as the top and bottom roller sets are rotated. In accordance with this invention a single source of power such as motor 63 drives the upper and lower sets of rollers.

Upper rollers 14, 15, and 16 are ganged by chain 64 and upper rollers 17, 18 and 19 are ganged by chain 65. In like manner lower rollers 32 through 34, and 35 through 39 are ganged by chains 66 and 67. A large idler sprocket 68 is positioned below the motor 63. A chain 69 is trained over the drive motor sprocket 71, main idler 68, three other idlers 40, 41 and 72 as well as driven rollers 16 and 17 of the upper set and driven rollers 34 and 35 of the lower set to rotate the upper and lower rollers and move a duct through the machine.

The idlers 40 and 41 hold the chain in position to drive rollers 34 and 35. The idler 72 holds the chain in position to drive roller 17.

The idler rollers 40 and 41 are positioned immediately above lower set rollers 34 and 35. As the chain 69 is held in position by idler 68, movement of the lower roller set vertically does not affect the length of the chain 69, which is held tight in all positions of the lower roller set.

A tape applicator means indicated generally at 74 is provided for applying duct tape to duct board moving through the apparatus. The applicator means is mounted on a frame including side plates 75 and 76.

Figure 6:
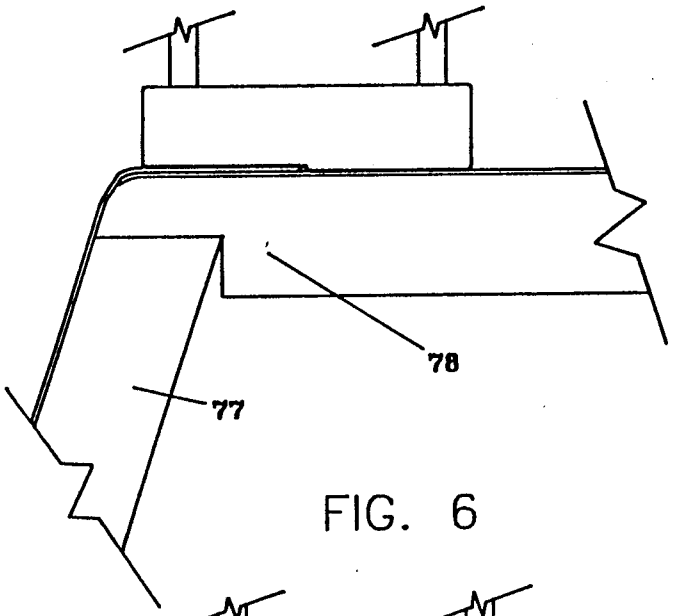
FIG. 6 is a fragmentary view of the smoothing iron and the joint being tapped on a four sided duct as in FIG. 5.
Figure 8:
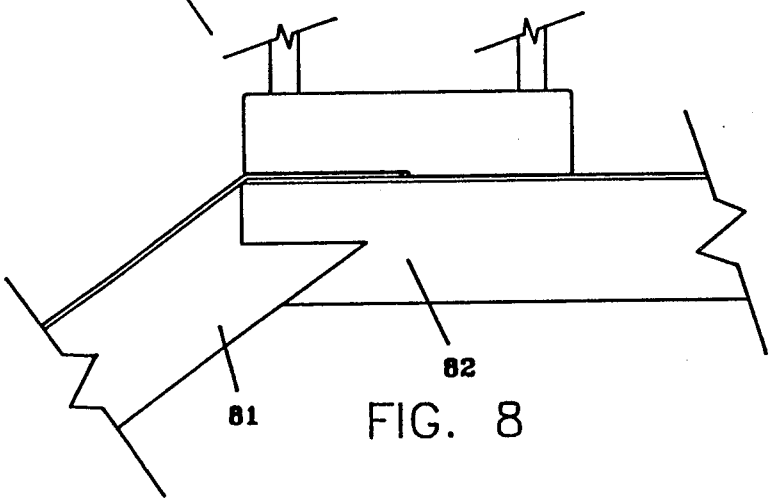
FIG. 8 is a fragmentary view of the smoothing iron and the joint being tapped on a ten sided duct as in FIG. 7.
Figure 5:
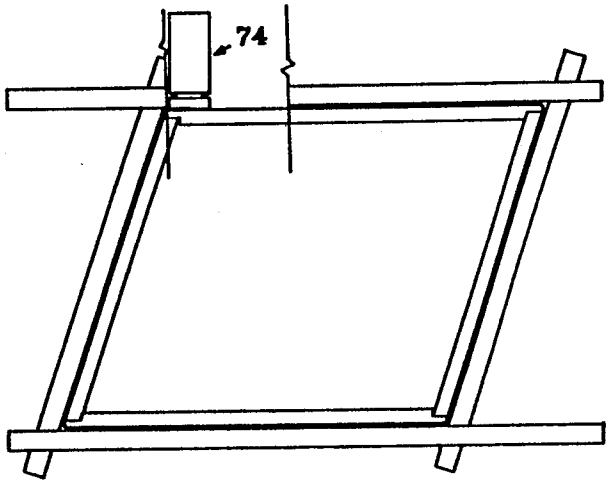
FIG. 5 is a schematic view showing the position of the tape applying system for four sided duct.
Figure 7:
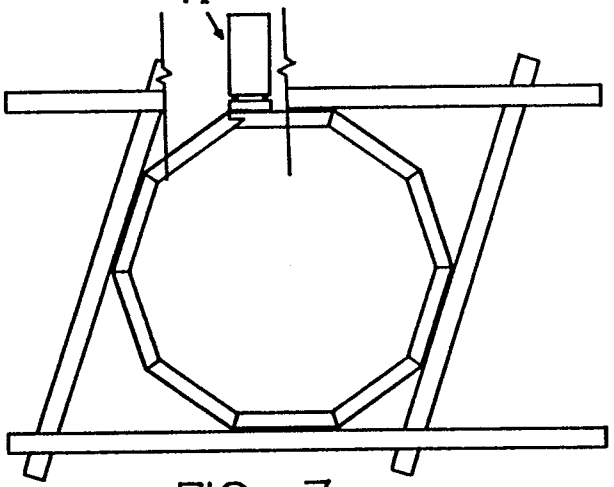
FIG. 7 is a schematic view showing the position of the tape applying system for a ten sided duct.

The tape applicator means is mounted for movement perpendicular to the direction of travel of the duct board through the apparatus to apply tape to duct board joints. This permits application of tape to board at different positions to permit the apparatus to close duct of four or more sides. FIGS. 5 and 6 illustrate the position of the tape applicator means over the corner of a four sided duct; that is, in the conventional position over the junction of the free sides 77 and 78 of the rectangular arranged duct. FIGS. 7 and 8 illustrate the position of the tape applicator means when taping a ten sided duct. When taping a decaduct the tape applicator is spaced from the side rollers. The duct may be held against the forces generated in applying the tape in any desired manner. For instance the joint between the free sides of the duct board may be fashioned in a special manner to permit the inter-engagement of the free sides of the duct to support the duct in position for application of the tape as shown in FIG. 8. Here the side panel 81 of one side edge of the duct board interlocks with the opposite side panel 82 to provide support for the joint while the tape is being applied.

The tape applicator is supported on the frame 11 by a support 83. This support carries horizontally spaced guides 84 and 85 on which the applicator is slidably mounted. The support 83 also carries a screw 86 having a nut 87 thereon. The nut is mounted for rotation on the frame 75-76. The nut may be rotated to adjust the position of the tap applicator across the path of the duct passing through the machine to apply the tape at the joint in the duct.

The tape applicator includes a spool 88 for mounting a roll of tape 89 for applying to the duct. The tape passes over a pair or rollers 91 and 92 for positioning the free end of the tape in the path of the duct.

A smoothing iron 93, which may be heated, is positioned to bear against the duct 94 as it passes through the machine to press the tape against the duct in the conventional manner. This iron has a slot 95 therein.

A knife 96 for severing the tape on the duct from the roll 89 is reciprocal in the slot 95. The knife is carried by an arm hinged on the frame 75–76.

Rotatable paddles 97 are driven by motor 98 to wipe the tape against the duct in the conventional manner.

Power may be provided the motor 98 in any conventional manner, as by energizing the motor 98 when the motor 63 is energized to drive the upper and lower roller sets.

Brake means are provided for holding the tape as it is cut by the knife 96. This means may be a plate 101 cooperable with a shoe 102 carried on solenoid 103. Preferable the solenoid is spring opened, and closed by application of power to the solenoid.

The knife is controlled by solenoid 104 which is also preferably spring opened, and closed by application of power.

In accordance with this invention the two solenoids 103 and 104 are controlled by switches carried by the tape applicator frame 75–76. For clarity of illustration the switches are positioned in the path of travel of the duct with their supports omitted.

The first switch to be engaged by the duct board is switch 105 which preferably is a normally closed switch which is opened by engagement with the duct board 94. This insures that the two solenoids are de-energized and the knife is raised and the brake is disengaged. Thus the knife is in an out-of-the-way position and the brake is disengaged as the duct board passes through the machine. The free end 89*a* of the tape is engaged by the duct board 94 and adheres to the duct board as it reaches the smoothing iron. The smoothing iron applies the tape to the duct board.

The second switch 106 is a normally open switch which is engaged after the first switch and closed by the duct board moving through the machine. The switches are arranged in series and thus closing of the second switch has no effect. As the duct moves past and disengages the first switch 105 this switch is closed to complete the circuit to the two solenoids. They are thus activated to close the brake to hold the tape and to move the knife through and cut the tape. The brake prevents movement of the tape while it is being cut. The switch 105 may be adjustably mounted to provided a slight tail of tape on the trailing end of the duct and this tail may be cut off by hand as the duct leaves the machine. As the second switch 106 is deactivated by disengagement of the duct it opens and interrupts current flow to the two solenoids which are opened by their springs. Thus no current flows in the solenoid circuit except in the brief period in which the tail end of the duct passes from the first to the second switch.

The foregoing disclosure and description of the invention are illustrative and explanatory thereof and various changes in the method and apparatus and system and in the size, shape and materials, as well as in the details of the illustrated construction, may be made within the scope of the claims without departing from the spirit of the invention.

What is claimed is:

1. A combination closure apparatus for closing duct board having four or more sides comprising:

opposed upper and lower roller sets arranged in parallel planes, means for changing the spacing between said upper and lower roller sets to accommodate different size ducts, opposed side roller sets arranged in parallel planes, means for changing the spacing between said side roller sets to accommodate different size ducts, means for driving said upper and lower roller sets to move duct through the apparatus utilizing a single power source and a chain drive engaging said upper and lower roller sets in all relative positions of said upper and lower roller sets, tape applicator means for applying duct tape to duct board moving through the apparatus, means mounting said tape applicator means for movement perpendicular to the direction of travel of duct board through the apparatus to apply tape to duct board joints at different positions in the apparatus, said tape applicator means comprising;

a spool for supporting a roll of tape, smoothing iron means positioned to bear against a duct board at a joint to be closed, a slot in said iron means, a knife reciprocal in said slot to cut free a section of tape applied to a duct board joint from a roll of tape carried on said spool, rotatable means for wiping tape against a duct board, brake means for holding the tape while it is being cut by the knife, and electrical means including switch means in the path of and engagable and disengagable by a duct board moving through the apparatus for retracting said knife and releasing said brake upon engagement of said means and upon disengagement extending said knife and engaging said tape with said brake means.

2. The apparatus of claim 1 wherein said electrical means includes solenoids spring loaded to retracted position, said switch means is a pair of spaced switches successively engaged by a duct board with engagement of the first switch insuring retraction of said knife and release of said tape by said brake and engaging the brake and extending the knife when said first switch is disengaged, and the second switch when released by being disengaged by a duct board opens the circuit and removes power from the solenoids.

3. The apparatus of claim 2 wherein said first switch is a normally closed switch and said second switch is a normally open switch.

4. The apparatus of claim 1 wherein said drive chain is held against one set of rollers by idler rollers carried by a movable frame member carrying the said set of rollers and the idler rollers.

5. The apparatus of claim 3 wherein said drive chainis held against one set of rollers by idler rollers carried by a movable frame member carrying the said set of rollers and the idler rollers.

* * * * *